US007753720B2

(12) United States Patent
Emoto et al.

(10) Patent No.: US 7,753,720 B2
(45) Date of Patent: Jul. 13, 2010

(54) ON-TRAIN INFORMATION TRANSMITTING/RECEIVING SYSTEM

(75) Inventors: Norishige Emoto, Tokyo (JP); Kazuhiro Iga, Tokyo (JP); Fumiaki Eura, Tokyo (JP); Yoichi Masubushi, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 434 days.

(21) Appl. No.: 11/667,123

(22) PCT Filed: Jun. 8, 2006

(86) PCT No.: PCT/JP2006/311522

§ 371 (c)(1),
(2), (4) Date: May 7, 2007

(87) PCT Pub. No.: WO2007/007495

PCT Pub. Date: Jan. 18, 2007

(65) Prior Publication Data

US 2009/0042436 A1 Feb. 12, 2009

(30) Foreign Application Priority Data

Jul. 12, 2005 (JP) ..... 2005-203110

(51) Int. Cl.
*H01R 11/00* (2006.01)

(52) U.S. Cl. ..... 439/502

(58) Field of Classification Search ..... 439/502, 439/35, 98; 174/103, 105 R, 51
See application file for complete search history.

(56) References Cited

U.S. PATENT DOCUMENTS 4,954,101 A * 9/1990 Nelson ..... 439/502
6,201,853 B1 * 3/2001 Butler et al. ..... 379/21
7,439,448 B2 * 10/2008 Masuda et al. ..... 174/125.1
2004/0040736 A1 * 3/2004 Nishimura ..... 174/113 R
2004/0256142 A1 12/2004 Masuda et al.

FOREIGN PATENT DOCUMENTS

JP 60-197113 A 10/1985

(Continued)

OTHER PUBLICATIONS

International Search Report dated Aug. 18, 2006, PCT/JP2006/311522.

*Primary Examiner*—Javaid Nasri
(74) *Attorney, Agent, or Firm*—Buchanan Ingersoll & Rooney PC

(57) ABSTRACT

An on-train information transmitting/receiving system is provided that can be implemented in an environment with significant external noise and allows high speed transmission to be carried out between transmitter/receivers mounted in vehicles without having to develop a new jumper cable used between the vehicles while cost increase is prevented. A transmission path that connects transmitter/receivers 10 provided in vehicles included in a train to process train-related information in association with one another includes an inside vehicle interconnection cable 20 provided in a vehicle and a jumper cable interconnecting the vehicles. The jumper cable includes a plurality of shield electric wires 33 each produced by coating a conductor 35 with a shield 36, two such shielded electric wires 33 are paired to form the transmission path, the shields 36 of the pair of the shield electric wires 33 are connected with each other at both ends of the shield wires 33, and the shields 36 connected with each other are grounded at one end of the shield wires 33.

2 Claims, 12 Drawing Sheets

FOREIGN PATENT DOCUMENTS

| | | | |
|---|---|---|---|
| JP | 61-196172 | A | 8/1986 |
| JP | 7-30561 | A | 1/1995 |
| JP | 8-331097 | A | 12/1996 |
| JP | 2005-12925 | A | 1/2005 |

* cited by examiner

ON-TRAIN INFORMATION TRANSMITTING/RECEIVING SYSTEM

TECHNICAL FIELD

The present invention relates to an on-train information transmitting/receiving system that controls various kinds of information used to monitor, control, and inspect various kinds of electrical equipment mounted in a train and transmits/receives the information among vehicles connected in the train.

BACKGROUND ART

As a conventional technique, Patent Document 1 discloses for example a method of connecting shield wires used as an acoustic cable or a video cable, and two shielded cables are used as a path for transmitting/receiving signals. One of the cables is grounded as a reference line, and the shields of the cables are grounded on the side opposite to the cables. Alternatively, one shield wire is grounded at one side of the cables, and the shield wires are connected to each other on the other side.

Patent Document 1: JP-A-7-30561 (pp. 3 to 4, FIG. 1).

DISCLOSURE OF THE INVENTION

Problems to be Solved by the Invention

While Patent Document 1 discloses a method of connecting shield wires, the disclosure is about acoustic equipment, and the connection method cannot be applied as it is to on-train equipment subjected to significant external noise.

In the acoustic equipment, the distance between devices to be connected is relatively short and only one kind of cables is used to complete the connection between the devices. Meanwhile, when devices to be connected are mounted in separate vehicles like on-train equipment, a cable for inside vehicle interconnection and a jumper cable, i.e., a special cable used for transmission between vehicles are necessary. In other word, these two kind of cables, the cable for inside vehicle interconnection and the jumper cable must be used, and connection and grounding methods therefor will be necessary.

The invention is directed to a solution to the above described disadvantages, and it is an object of the invention to obtain an on-train information transmitting/receiving system that can be implemented in an environment with significant external noise and allows high speed transmission to be carried out between transmitter/receivers mounted in vehicles without having to develop a new jumper cable used between the vehicles.

Means for Solving the Problems

An on-train information transmitting/receiving system according to the invention includes a plurality of transmitter/receivers provided in a plurality of vehicles included in a train to process train-related information in association with one another and a transmission path that connects the transmitter/receivers in adjacent vehicles, the transmission path includes an inside vehicle interconnection cable provided in the vehicle and a jumper cable that extends between vehicles, the jumper cable has a plurality of shield wires each produced by coating a conductor with a shield, the transmission path includes two of the shield wires as a pair, the shields of the pair of shield wires are connected with each other at both ends of the shield wires, and the shields connected with each other are grounded on one end side of the shield wires.

ADVANTAGES OF THE INVENTION

As described above, the invention includes a plurality of transmitter/receivers provided in a plurality of vehicles included in a train to process train-related information in association with one another and a transmission path that connects the transmitter/receivers in adjacent vehicles, the transmission path includes an inside vehicle interconnection cable provided in the vehicle and a jumper cable that extends between the vehicles, the jumper cable has a plurality of shield wires each produced by coating a conductor with a shield, the transmission path includes two of the shield wires as a pair, the shields of the pair of shield wires are connected with each other at both ends of the shield wires, and the shields connected with each other are grounded on one end side of the shield wires. Therefore, when the transmitter/receivers mounted in the vehicles transmit train-related information, transmission at higher speed than before can be carried out using a general jumper cable without having to develop a new jumper cable.

DESCRIPTION OF THE REFERENCE NUMERALS AND SIGNS

Figure 1:
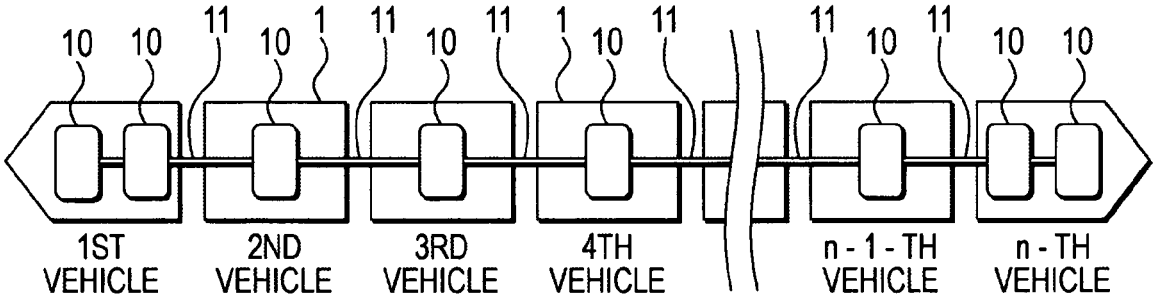
FIG. 1 is a schematic view of the general structure of an on-train information transmitting/receiving system according to first and second embodiments of the invention.

1 vehicle
10 transmitter/receiver
11 transmission path
20 inside vehicle interconnection cable
24 sheath (protective coating)
25 conductor
26 shield (shield layer)
27 insulator
30 jumper cable
31 connecting terminal block
32 non-shield wire
33 shield wire
34 sheath (protective coating)
35 conductor
36 shield (shield layer)
37 insulator
38 insulator
39 insulator
40 electrical coupler
41 contact
100 shield ground wire
101 shield connection wire

BEST MODE FOR CARRYING OUT THE INVENTION

First Embodiment

FIG. 1 is a schematic view of the general structure of an on-train information transmitting/receiving system according to a first embodiment of the invention.

In FIG. 1, a transmitter/receiver 10 is mounted in each of a plurality of vehicles 1 that constitute a train, and the transmitter/receivers operate in association with one another to process train-related information. Transmitter/receivers 10 mounted in adjacent vehicles are connected by a transmission path 11.

Figure 2:
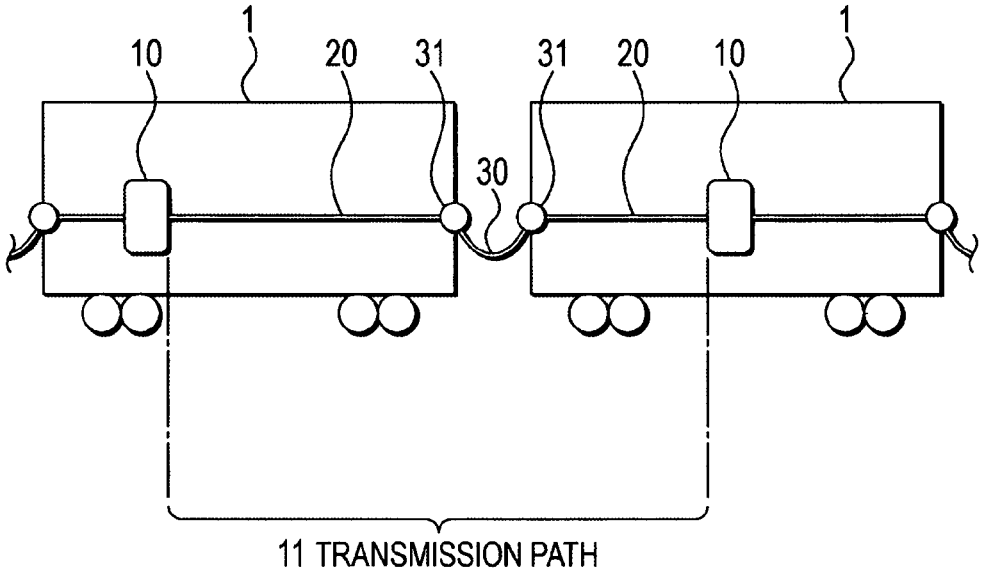
FIG. 2 is a view of a coupling part between vehicles in the on-train information transmitting/receiving system according to the first embodiment of the invention.

FIG. 2 is a view of a vehicle coupling part in the on-train information transmitting/receiving system according to the first embodiment of the invention, in which two adjacent transmitter/receivers among the plurality of transmitter/receivers mounted in the plurality of vehicles are extracted for illustration and a jumper cable at the vehicle coupling part is particularly shown.

In FIG. 2, 1, 10, and 11 are the same as those in FIG. 1. The transmission path 11 is implemented by connecting inside vehicle interconnection cables 20 and a jumper cable 30 that extends between the vehicles. A transmitter/receiver 10 is connected to the other transmitter/receiver 10 mounted in the adjacent vehicle through the inside vehicle interconnection cable 20 and the jumper cable 30 that extends between the vehicles and the inside vehicle interconnection cable 20. The inside vehicle interconnection cable 20 and the jumper cable 30 are connected by a connection terminal block 31.

Figure 3:
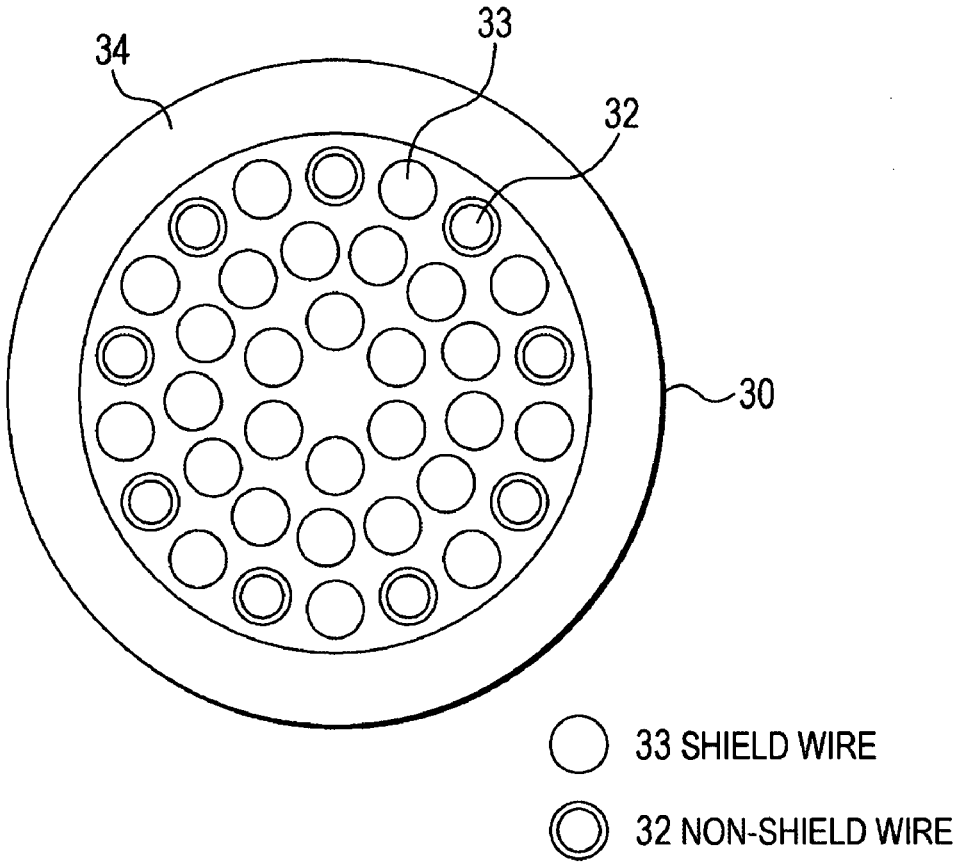
FIG. 3 is a sectional view of the structure of a jumper cable in the on-train information transmitting/receiving system according to the first and second embodiments of the invention.

FIG. 3 is a sectional view of the structure of the jumper cable in the on-train information transmitting/receiving system according to the first embodiment of the invention.

In FIG. 3, the jumper cable 30 is produced by having a plurality of shield wires 33 and non-shield wires 32 twisted into a bundle and coating the bundle with a sheath 34 (protective coating). The number of wires, arrangement and diameters vary and the invention is not limited to the structure shown in FIG. 3.

Figure 4:
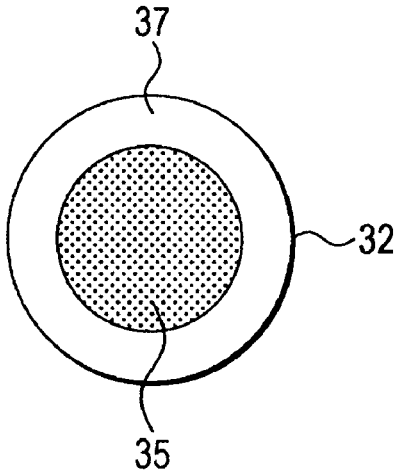
FIG. 4 is a sectional view of the structure of a non-shield wire in the jumper cable in FIG. 3.

FIG. 4 is a sectional view of a non-shield wire included in the jumper cable in FIG. 3.

In FIG. 4, the non-shield wire 32 included in the jumper cable 30 is produced by coating a conductor 35 with an insulator 37.

Figure 5:
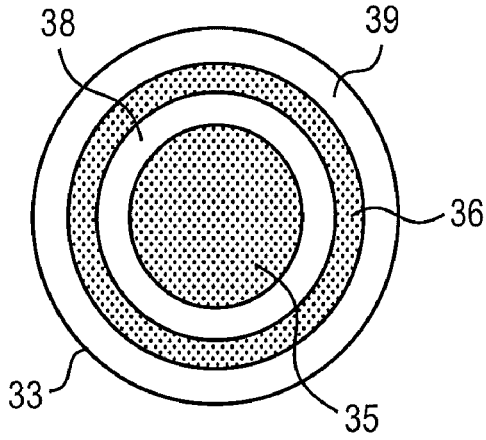
FIG. 5 is a sectional view of the structure of a shield wire included in the jumper cable in FIG. 3.

FIG. 5 is a sectional view of the structure of a shield wire included in the jumper cable in FIG. 3.

In FIG. 5, the shield wire 33 included in the jumper cable 30 is produced by coating a conductor 35 with an insulator 38, having its outer side further covered with a shield 36 (shield layer) of a copper wire knitted into a tube, and then coating its outer side further with an insulator 39.

The jumper cable 30 that directly extends between vehicles must have a high mechanical strength. Therefore, a hard copper wire is provided in the center of the conductor 35 in the jumper cable 30, and a soft copper wire is twisted therearound to form the conductor.

Figure 6:
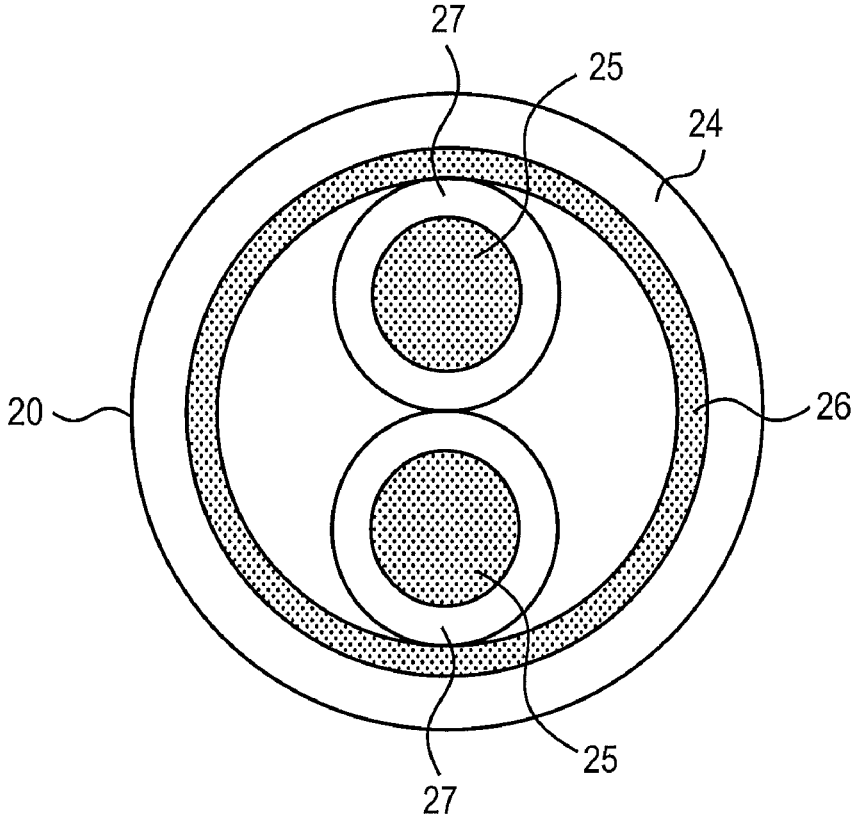
FIG. 6 is a sectional view of the structure of a twisted pair cable used as an inside vehicle interconnection cable in the on-train information transmitting/receiving system according to the first and second embodiments of the invention.

FIG. 6 is a sectional view of the structure of a twisted pair cable used as an inside vehicle interconnection cable for the on-train information transmitting/receiving system according to the first embodiment of the invention.

In FIG. 6, the shielded twisted pair (hereinafter referred to as "STP") cable used as the inside vehicle interconnection cable 20 is produced by twisting two insulated electric wires that are each produced by coating a conductor 25 with an insulator 27 and having its periphery coated with a shield 26 and then a sheath 24.

Figure 7:
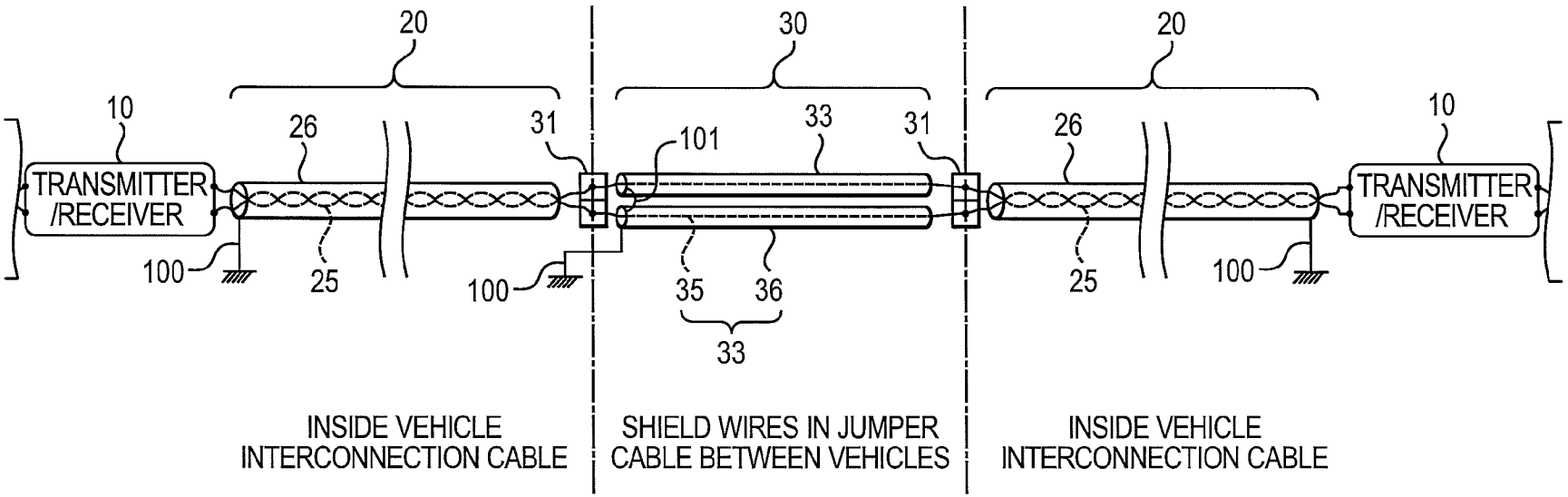
FIG. 7 is a view showing a general method of connecting shield wires in the jumper cable in FIG. 2.

FIG. 7 is a view showing a general method of connecting shield wires in the jumper cable in FIG. 2.

Figure 8:
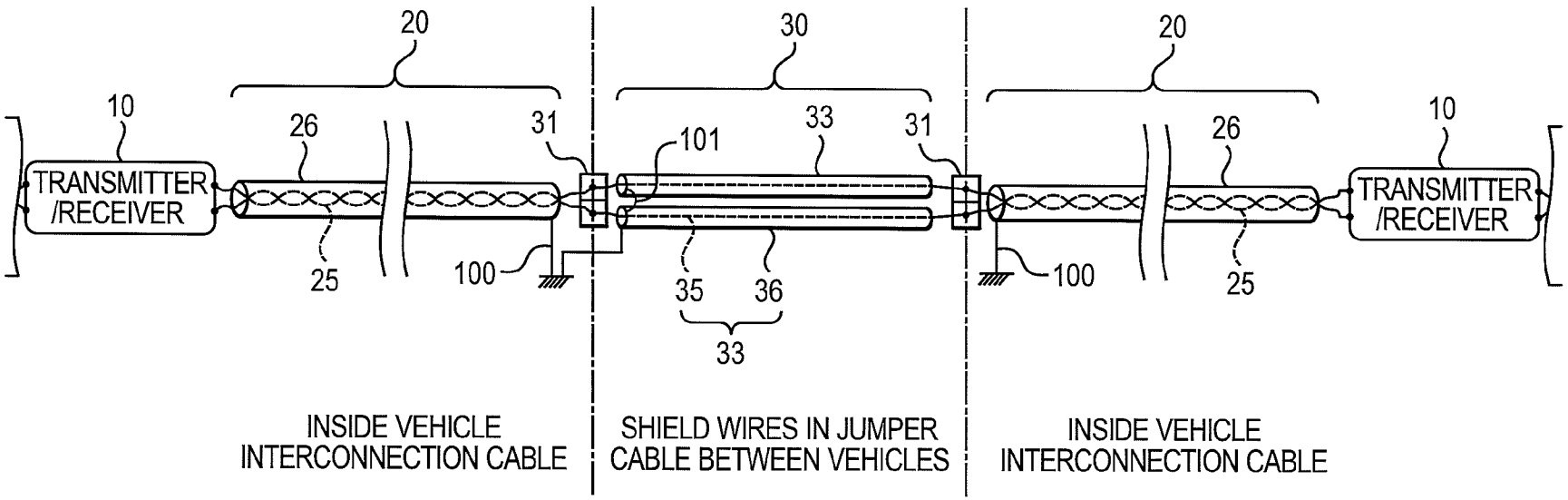
FIG. 8 is a view showing another general method of connecting the shield wires in the jumper cable in FIG. 2.

FIG. 8 is a view of another general method of connecting the shield wires in the jumper cable in FIG. 2.

FIGS. 7 and 8 each show a general method of connecting shield wires 33 in the jumper cable 30 in the transmission path that connects the transmitter/receivers 10 mounted in the adjacent vehicles shown in FIG. 2.

In FIGS. 7 and 8, 10, 20, and 31 are the same as those in FIG. 2, 25 and 26 are the same as those in FIG. 6, and 33, 35 and 36 are the same as those in FIG. 5. The two shield wires 33 in the jumper cable 30 are connected with each other by a shield connection wire 101 on one end side and grounded to the vehicle body by a shield ground wire 100. Note that the transmitter/receivers 10 are each connected to another transmitter/receiver 10 in the other adjacent vehicle, which is omitted.

Figure 9:
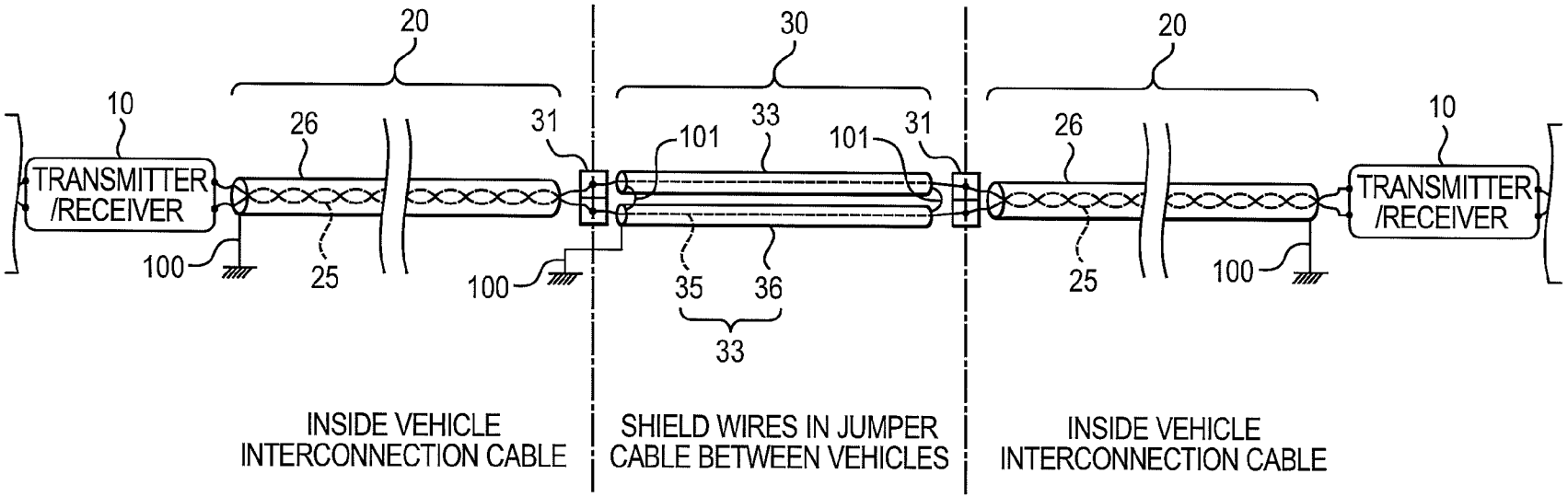
FIG. 9 is a view showing a method of connecting the jumper cable in the on-train information transmitting/receiving system according to the first embodiment of the invention.

FIG. 9 is a view showing a method of connecting the jumper cable in the on-train information transmitting/receiving system according to the first embodiment of the invention and the figure corresponds to FIG. 7.

Figure 10:
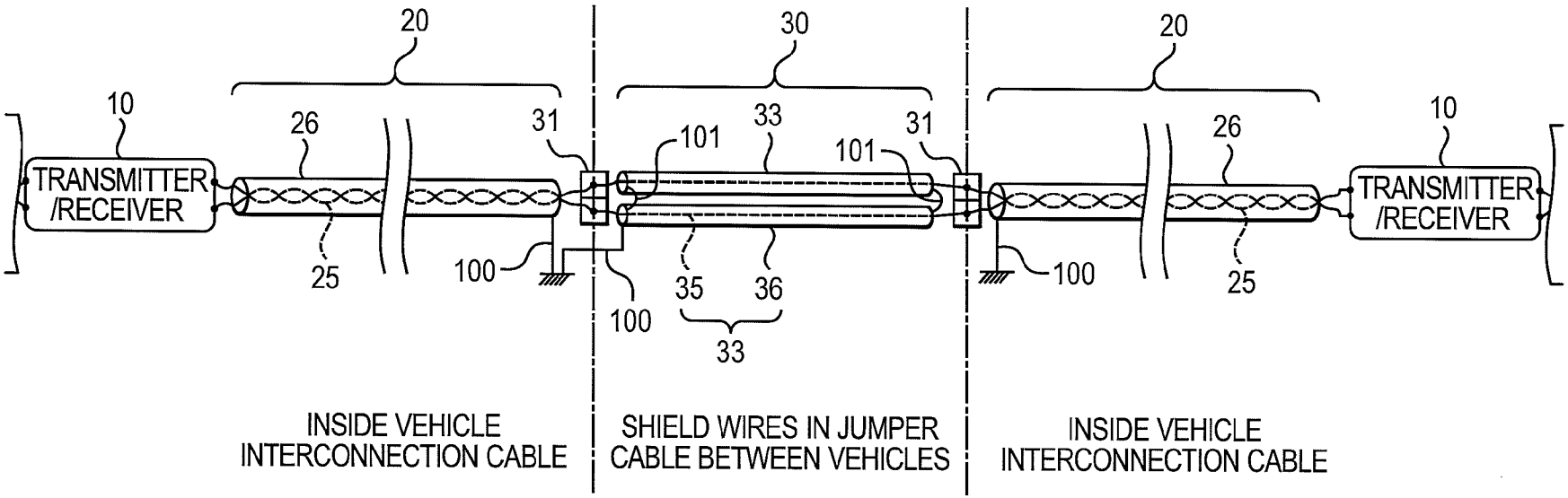
FIG. 10 is a view showing another method of connecting the jumper cable in the on-train information transmitting/receiving system according to the first embodiment of the invention.

FIG. 10 is a view showing another method of connecting the jumper cable in the on-train information transmitting/receiving system according to the first embodiment of the invention and the figure corresponds to FIG. 8.

FIGS. 9 and 10 each show a method of connecting the shield wires 33 in the jumper cable 30 in the transmission path 11 between the transmitter/receivers 10 mounted in the adjacent vehicles shown in FIG. 2.

In FIGS. 9 and 10, 10, 20, and 31 are the same as those in FIG. 2, 25 and 26 are the same as those in FIG. 6, and 33, 35, and 36 are the same as those in FIG. 5. The two shield wires 33 in the jumper cable 30 are connected with each other at both ends by a shield connection wire 101 and grounded to the vehicle body by a shield ground wire 100. Note that the transmitter/receivers 10 are each connected to another transmitter/receiver 10 in the other adjacent vehicle, which is omitted.

The invention concerns a connection method in the transmission path 11 in FIG. 1, and particularly concerns grounding the shield wires 33 in the jumper cable 30 provided between the vehicles 1 in FIG. 2.

The structures of the inside vehicle interconnection cable and the jumper cable are shown in FIG. 6 and FIGS. 3 to 5.

In general, a shielded cable is resistant against external noise. Meanwhile, a train has various kinds of electrical equipment operating at high voltage or high frequency, and therefore noise is constantly generated. Therefore, an STP cable as shown in FIG. 6 is used as a transmission path within a vehicle. Two shield wires 33 are selected among the electric wires included in the jumper cable 30 and used as a transmission path at the part connecting the vehicles.

Now, with reference to FIGS. 7 to 10, the first embodiment will be described in detail.

In FIGS. 7 and 8, the shield 26 of the STP cable and the shields 36 of the shield wires 33 in the jumper cable 30 are each grounded to the vehicle body by a shield ground wire 100 on one side of the cable. This is because the potential of the vehicle constantly changes in the train and current can be passed through the shield wire 33 when the shield wire is grounded to the vehicle body at both ends. Therefore, the grounding is carried out at one end.

The shield of the STP cable is grounded by the shield ground wire 100 on the side of the transmitter/receiver 10 in FIG. 7 and on the side of the connection terminal block 31 to the jumper cable in FIG. 8.

Note that, though not shown, the shield 26 of the STP cable provided in one vehicle may be grounded to the vehicle body on the side of the transmitter/receiver 10 and the shield 26 of the STP cable provided in the other vehicle may be grounded to the vehicle body on the side of the connection terminal block 31.

Two shield wires 33 are used as a pair in the jumper cable 30, and therefore, at the time of grounding, it is common that the two shields 36 are connected on one end side of the shield wires 33 by a shield connection wire 101 and grounded to the vehicle body by one shield ground wire 100 as shown in FIGS. 7 and 8.

Now, a method of connecting shield wires according to the invention will be described in conjunction with FIGS. 9 and 10.

In FIGS. 9 and 10, the methods of connecting the shields 36 of the shield wires 33 in the jumper cable 30 is different from those shown in FIGS. 7 and 8. More specifically, for the reason described above, the shields 36 of the shield wires 33 are grounded to the vehicle body by the shield ground wire 100 on one side, while in FIGS. 7 and 8, the shields 36 of the two shield wires 33 are connected with each other by the shield connection wire 101 on the grounding side and then connected to the vehicle body on one side.

Meanwhile, in FIGS. 9 and 10, the shields 36 are connected with each other by the shield connection wire 101 at both ends of the shield wires 33 and then connected to the vehicle body by the shield ground wire 100 on one side.

According to evaluations carried out by the inventors, it was found that the connection methods in FIGS. 9 and 10 provided higher transmission quality than the connection methods in FIGS. 7 and 8.

The transmission quality can be degraded by the effect of reflection or attenuation of signals passed through the transmission path 11, but the reflection or attenuation is generated at discontinuity in the characteristic impedance of the cable. The characteristic impedance of an STP cable is stable, while the characteristic impedance in the jumper cable 30 significantly changes depending on the arrangement combination of the shield wires 33 selected as the transmission path 11 or the frequency. Therefore, signals are reflected or attenuated at the boundary between the STP cable and the jumper cable 30, which degrades the transmission quality.

If the STP cable can be entered in the jumper cable, the degradation of the transmission quality can be prevented, but the jumper cable will have a more complex structure as a result and the cost can be increased.

According to evaluations carried out by the inventors, by the connection methods in FIGS. 9 and 10, the characteristic impedance of the jumper cable 30 was stabilized regardless of the arrangement combination of the shield wires 33 selected as a transmission path or the frequency and became substantially equal to the characteristic impedance of the STP cable. This is for the following reason.

In balanced transmission, two cables are used as a pair as a transmission path. The characteristic impedance of the cable is approximated by the square root of (L/C) where L is the inductance of the cable and the capacitance C between the cables depends on the distance between the paired cables (in inverse proportion).

If the paired cables are solid wire shield cables, the following expression holds:

$$C=1/((1/C1)+(1/C2)+(1/C3))$$

where C1 is the capacitance at one shield cable (conductive wire-shield), C2 is the capacitance at the other shield cable (conductive wire-shield), C3 is the capacitance between (one shield-the other shield), and C1 and C2 are stable because they depend on the internal structure of the shield wires and the material.

At the time, if the shields are connected at both ends, the capacitance C3 between the shield wires does not exist, and the following expression holds:

$$C=1/((1/C1)+(1/C2))$$

Therefore, C is a stable value. Therefore, almost the same characteristic impedance is obtained for any shield cables in the jumper cable used as a pair if the shields are connected at both ends.

In contrast, if the shields are connected only on one end side, the value of C3 is different between the side on which the shields of the cables are connected and the side on which the shields of the cables are not connected, and the characteristic impedance is not stable.

According to the first embodiment, the two shield wires in the jumper cable are connected at both ends by a shield connection wire, and the connected wires are grounded to a vehicle by a shield ground wire, so that transmission between transmitter/receivers mounted in different vehicles can be carried out at higher speed than before using a general jumper cable without having to develop a new jumper cable that is difficult and high cost to manufacture.

Second Embodiment

Figure 11:
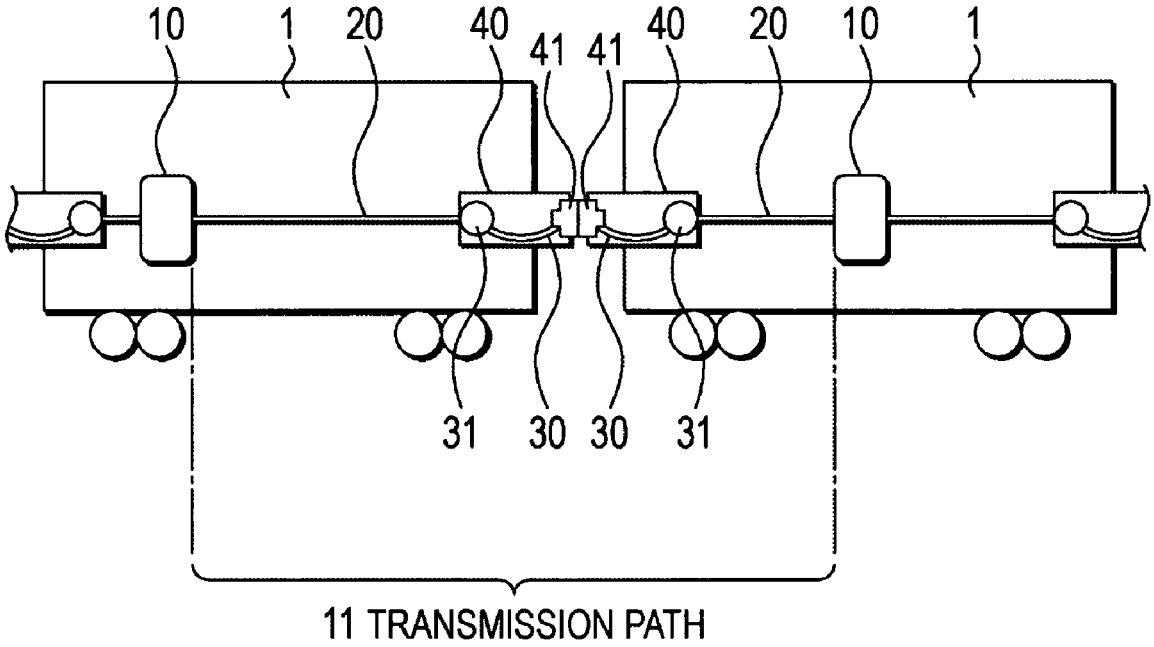
FIG. 11 is a view of the structure of a vehicle coupling part in the on-train information transmitting/receiving system according to the second embodiment of the invention.

FIG. 11 is a view of the structure of a coupling part between vehicles in an on-train information transmitting/receiving system according to a second embodiment of the invention. Two adjacent transmitter/receivers among transmitter/receivers mounted in a plurality of vehicles are extracted for illustration, and an electrical coupler provided at the coupling part between the vehicles is expressly shown. Note that the general structure of the second embodiment is substantially the same as that of the first embodiment (FIG. 1).

In FIG. 11, 1, 10, 20, 30, and 31 are the same as those in FIG. 2. An electrical coupler 40 is provided at both ends of the vehicles, and the electrical connection with adjacent vehicles is made through the electrical couplers 40. The coupling part in the electrical coupler 40 includes a contact 41, which is connected with a contact 41 in an electrical coupler 40 mounted in an adjacent vehicle.

A cable provided in the electrical coupler 40 must have a mechanical strength, and therefore a jumper cable 30 the same as the first embodiment is used therefor.

Figure 12:
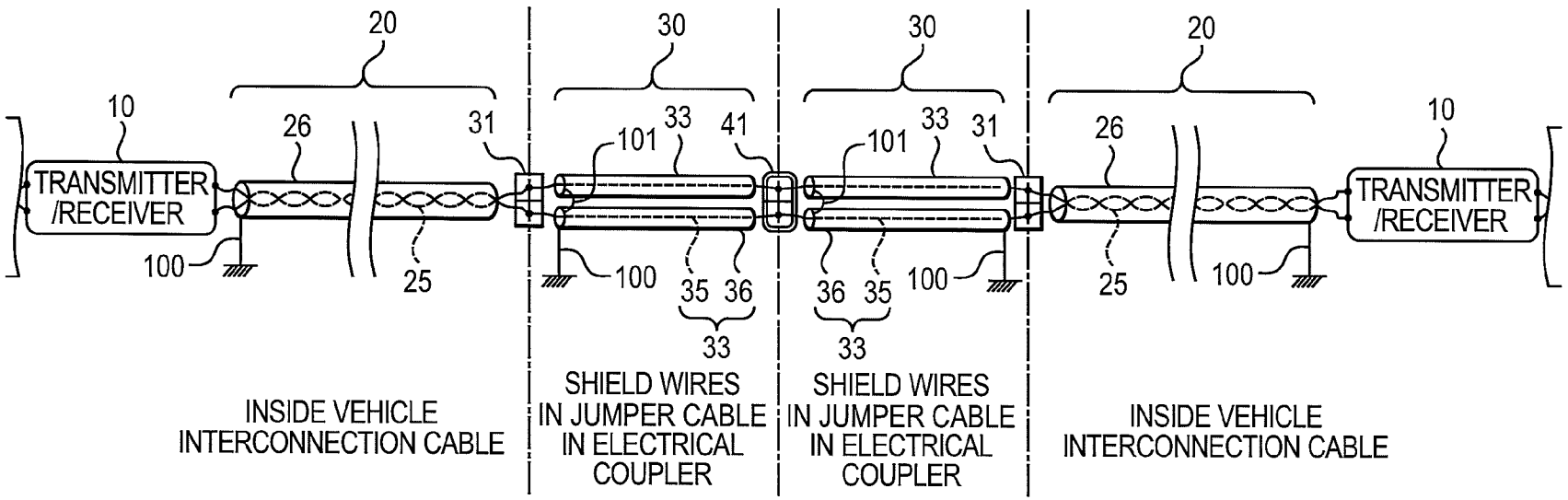
FIG. 12 is a view showing a general method of connecting shield wires in a jumper cable in an electrical coupler in FIG. 11.

FIG. 12 is a view showing a general method of connecting shield wires in a jumper cable in the electrical coupler in FIG. 11.

Figure 13:
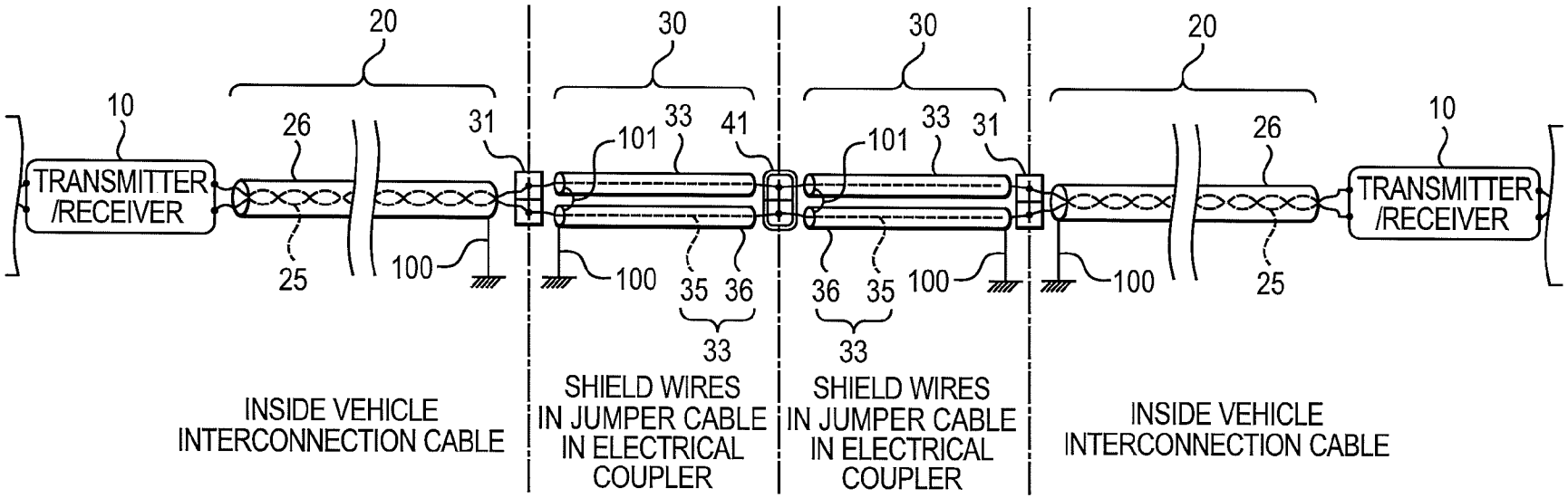
FIG. 13 is a view showing another general method of connecting the shield wires in the jumper cable in the electrical coupler in FIG. 11.

FIG. 13 is a view showing another general method of connecting shield wires in the jumper cable in the electrical coupler in FIG. 11.

FIGS. 12 and 13 each show a general method of connecting shield wires 33 in a jumper cable 30 in the electrical coupler 40 in FIG. 11.

In FIGS. 12 and 13, 10, 20, 31, and 41 are the same as those in FIG. 11, 25 and 26 are the same as those in FIG. 6, and 33, 35, and 36 are the same as those in FIG. 5. The two shield wires 33 in the jumper cable 30 in the electrical coupler 40 are connected to each other by the shield connection wire 101 on one end side and grounded to a vehicle body by the shield ground wire 100. Note that the transmitter/receiver 10 is also connected to a transmitter/receiver 10 mounted in the other adjacent vehicle, which is omitted.

Figure 14:
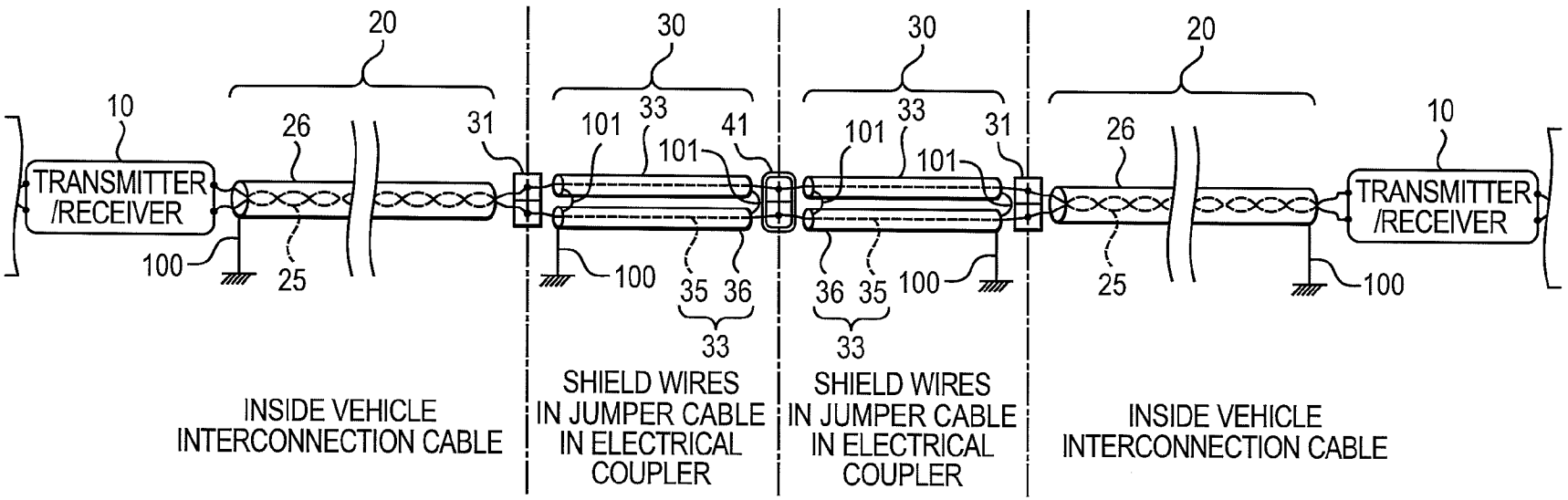
FIG. 14 is a view showing a method of connecting a jumper cable in an electrical coupler in the on-train information transmitting/receiving system according to the second embodiment of the invention.

FIG. 14 is a view showing a method of connecting a jumper cable in an electrical coupler in an on-train information transmitting/receiving system according to a second embodiment of the invention, and the figure corresponds to FIG. 12.

Figure 15:
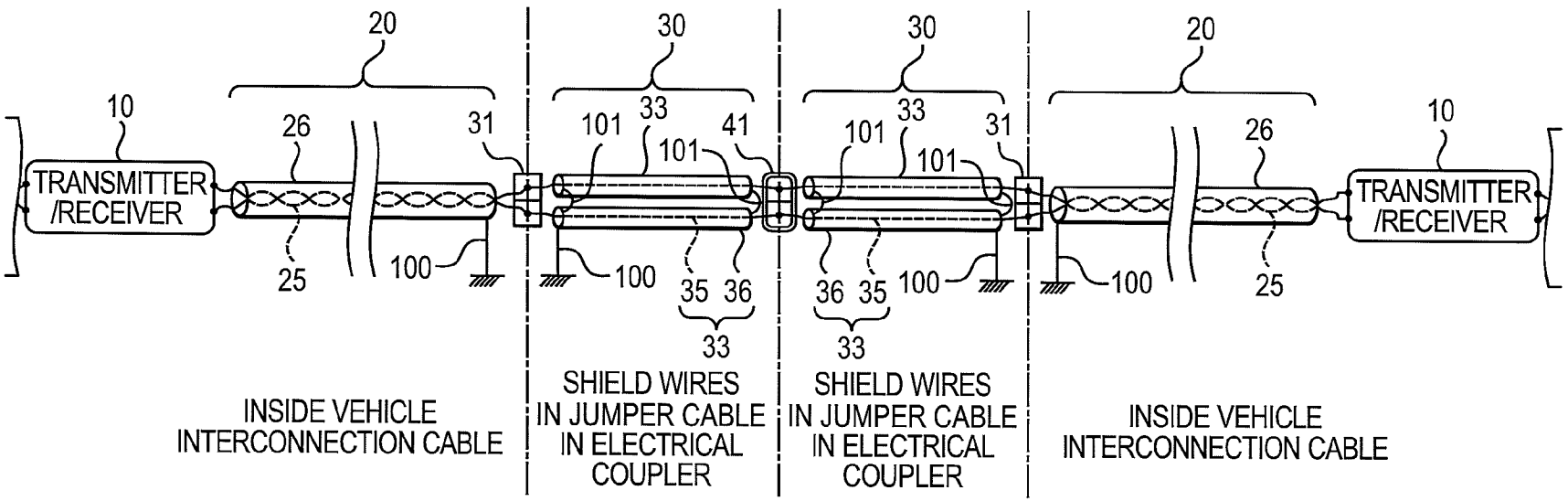
FIG. 15 is a view showing another method of connecting the jumper cable in the electrical coupler in the on-train information transmitting/receiving system according to the second embodiment of the invention.

FIG. 15 shows another method of connecting the jumper cable in the electrical coupler in the on-train information transmitting/receiving system according to the second embodiment of the invention and the figure corresponds to FIG. 13.

FIGS. 14 and 15 each show a method of connecting the shield wires 33 in the jumper cable 30 in the electrical coupler 40 shown in FIG. 11 according to the invention.

In FIGS. 14 and 15, 10, 20, and 31 are the same as those in FIG. 11, 25 and 26 are the same as those in FIG. 6, and 33, 35, and 36 are the same as those in FIG. 5. The two shield wires 33 in the jumper cable 30 in the electrical coupler 40 are connected with each other at both ends by a shield connection wire 101 and grounded to the vehicle body by a shield ground wire 100. Note that the transmitter/receiver 10 is also connected to a transmitter/receiver 10 mounted in the other adjacent vehicle, which is omitted.

As shown in FIG. 11, the second embodiment concerns a method of connecting the shield wires when the electrical connection between adjacent vehicles is made through the electrical coupler 40, and the method will be described with the drawings.

Regarding FIGS. 12 and 13, the difference from the first embodiment shown in FIGS. 7 and 8 will be described. In FIGS. 12 and 13, transmitter/receivers 10 are connected through the elements in the following sequence: an inside vehicle interconnection cable 20, a connection terminal block 31, a pair of shield wires 33, a contact 41 in an electrical coupler, a pair of shield wires 33, a connection terminal block 31, and an inside vehicle interconnection cable 20. The shields of the shield wire 33 are generally connected to the vehicle on the side of the connection terminal block 31.

In FIGS. 12 and 13, the shield wires 33 in the jumper cable 30 in the electrical coupler 40 are connected with each other at one end side of the shield wires 33 by the shield connection wire 101, and grounded to the vehicle body by the shield ground wire 100.

In FIGS. 14 and 15, the shield wires 33 in the jumper cable 30 in the electrical coupler 40 are connected with each other at both ends of the shield wires 33 by a shield connection wire 101 and grounded to the vehicle body by a shield ground wire 100.

By the method of connecting the shield wires in the electrical coupler, the same advantage as that brought about by the first embodiment is provided even if the electrical connection between vehicles is established by the electrical coupler.

According to the second embodiment, the shield wires in the jumper cable in the electrical coupler are connected with each other at both ends of the shield wires by a shield connection wire and grounded to the vehicle body by a shield ground wire, so that also in a train that allows vehicles to be electrically connected by electrical couplers, the same advantage as that brought about by the first embodiment is provided.

The invention claimed is:

1. An on-train information transmitting/receiving system, comprising:

a plurality of transmitter/receivers provided in a plurality of vehicles included in a train to process train-related information in association with one another; and a transmission path that connects the transmitter/receivers in adjacent vehicles, the transmission path including an inside vehicle interconnection cable provided in the vehicles and a jumper cable that extends between the vehicles, the inside vehicle interconnection cable comprising a shielded twisted pair of wires, the shield of which being grounded at one end thereof, the jumper cable having a plurality of shield wires each produced by coating a conductor with a shield, the transmission path including two of the shield wires as a pair connected to the shielded twisted pair of wires of the inside vehicle interconnection cable, the shields of the pair of shield wires being connected with each other at both ends of the shield wires, the shields connected with each other being grounded on one end side of the shield wires.

2. The on-train information transmitting/receiving system according to claim 1, further comprising a plurality of electrical couplers provided at both ends of each of the vehicles to electrically connect the vehicles by coupling their coupling parts, wherein the jumper cables are provided in the electrical couplers, and the jumper cables provided in the electrical couplers of adjacent vehicles are connected with one another through the coupling parts of the electrical couplers.

* * * * *